US011118412B2

(12) United States Patent
Henderson et al.

(10) Patent No.: US 11,118,412 B2
(45) Date of Patent: Sep. 14, 2021

(54) DOWNHOLE LOCATION INDICATION SYSTEM

(71) Applicant: Halliburton Energy Services, Inc., Houston, TX (US)

(72) Inventors: David William Henderson, Tioga, TX (US); Eddie Eddieberto Perez, McKinney, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 319 days.

(21) Appl. No.: 16/335,588

(22) PCT Filed: Dec. 28, 2016

(86) PCT No.: PCT/US2016/068888

§ 371 (c)(1),
(2) Date: Mar. 21, 2019

(87) PCT Pub. No.: WO2018/125083

PCT Pub. Date: Jul. 5, 2018

(65) Prior Publication Data

US 2020/0024912 A1 Jan. 23, 2020

(51) Int. Cl.

| | |
|---|---|
| ***E21B 17/08*** | (2006.01) |
| ***E21B 23/02*** | (2006.01) |
| ***E21B 47/09*** | (2012.01) |

(52) U.S. Cl.

CPC ..... *E21B 17/08* (2013.01); *E21B 23/02* (2013.01); *E21B 47/09* (2013.01)

(58) Field of Classification Search

CPC ..... E21B 17/08; E21B 17/00; E21B 23/02; E21B 23/03; E21B 23/00; E21B 23/12; E21B 47/09

See application file for complete search history.

(56) References Cited

U.S. PATENT DOCUMENTS

| | | | | |
|---|---|---|---|---|
| 4,722,392 | A | 2/1988 | Proctor et al. | |
| 5,477,923 | A * | 12/1995 | Jordan, Jr. | E21B 7/061 166/313 |
| 2001/0045281 | A1* | 11/2001 | Foster | E21B 34/12 166/278 |
| 2004/0031604 | A1 | 2/2004 | Huggins et al. | |
| 2014/0166312 | A1 | 6/2014 | Richards et al. | |
| 2016/0273291 | A1* | 9/2016 | Scott | E21B 23/02 |
| 2016/0298404 | A1 | 10/2016 | Beckett et al. | |

OTHER PUBLICATIONS

International Search Report and Written Opinion of PCT Application No. PCT/US2016/068888 dated Sep. 7, 2017: pp. 1-9.

* cited by examiner

*Primary Examiner* — George S Gray
(74) *Attorney, Agent, or Firm* — Chamberlain Hrdlicka

(57) ABSTRACT

A downhole indicating device includes a collet body and a slidable collet comprising a protrusion and surrounding and slidable along a length of the collet body between a low snap position and a high snap position. In the low snap position, the protrusion is depressible under a low snap force, and in the high snap position, the protrusion is depressible under a high snap force with the low snap force being less than the high snap force.

19 Claims, 4 Drawing Sheets

DOWNHOLE LOCATION INDICATION SYSTEM

This section is intended to provide relevant contextual information to facilitate a better understanding of the various aspects of the described embodiments. Accordingly, it should be understood that these statements are to be read in this light and not as admissions of prior art.

In constructing subterranean wells, numerous tools, equipment, and tubular strings are lowered downhole or installed in the wellbore. It is often important to know the depth or location of such components within a well. For example, when installing casing, it is important to know exactly when the casing segment has been lowered to the appropriate position relative to the installed casing string. However, due to the depth of some wells, and especially for offshore operations where positioning of the rig is subject to prevailing sea conditions, it may be challenging to know the exact depth or position of a component being lowered or lifted.

BRIEF DESCRIPTION OF THE DRAWINGS

For a detailed description of the embodiments of the invention, reference will now be made to the accompanying drawings in which.

DETAILED DESCRIPTION

Figure 1:
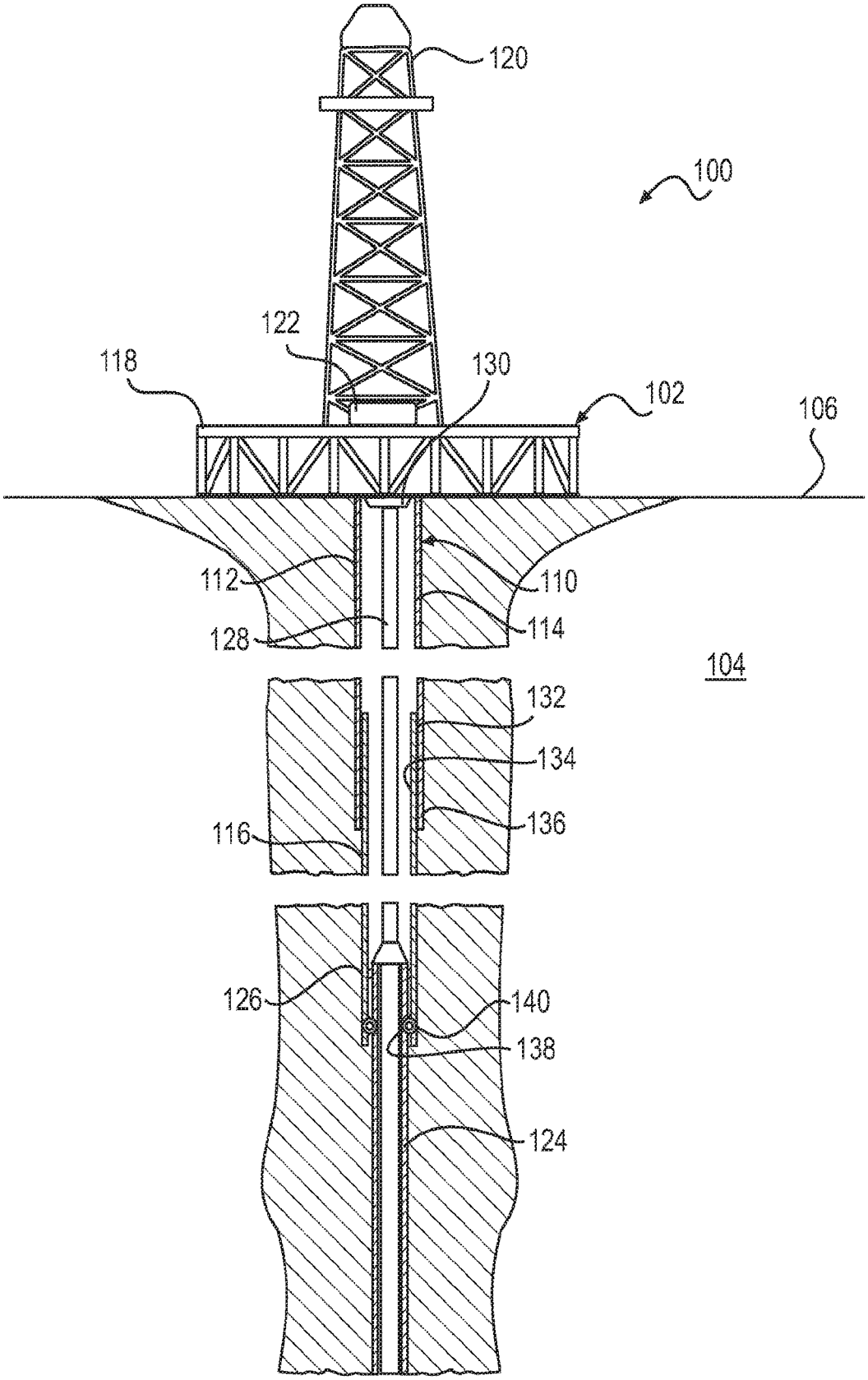
FIG. 1 illustrates a well system with downhole location indication devices, in accordance with one or more embodiments, in accordance with one or more embodiments.

Referring now to the figures, FIG. 1 illustrates a well system 100 with downhole location indication devices, in accordance with one or more embodiments. The system includes a rig 102 located at a well site 106 over a subterranean formation 104 and a well 110 formed in the formation 104. The rig 102 may include a work deck 118 that supports a derrick 120. The derrick 120 supports a hoisting apparatus 122 for lowering and raising pipe strings into or out of the well 110.

The well 110 penetrates the various earth strata to form wellbore 112. Disposed within wellbore 112 is a casing string 114, such as a conductor casing, which is preferably cemented within wellbore 112. Casing string 114 is typically formed from a plurality of steel pipes that coupled together by couplings. Partially disposed within and extending beyond casing string 114 is a casing string 116, such as an intermediate casing, which is preferably cemented within wellbore 112 and constructed of a plurality of steel pipes connected with couplings therebetween.

Casing string 114 may be connected with a well installation 130 via a portion of the wellhead known as a casing hanger (not pictured). The location of the casing hanger is known. Likewise, the distance casing string 114 extends downwardly into wellbore 112, the casing string length, is also known. Depth referencing of any location within casing string 114 can thus be accomplished relative to the known and fixed position of the wellhead. As such, the location of a depth referencing element 132 in the wellbore can be precisely determined relative to the wellhead.

As illustrated, casing string 116 is installed within casing string 114. During the installation process, casing string 114 is run in the well on a conveyance such as service string 128 until an indicating or locating device 136 of casing string 116 engages with the depth referencing element 132 of casing string 114. The indicating device 136 triggers a liner running weight response at the surface when interaction with the depth referencing element 134 occurs. For example, depending on the design of indicating device 136 and depth referencing element 134, an increase of in liner running weight could signal that indicating device 136 and depth referencing coupling 134 have engaged. The amount of running weight required to engage the indicating device 136 and depth reference coupling can be called snap force. Thereafter, suspension tool 132 is actuated to sealably and grippingly secure casing string 116 within casing string 114. Since the location of depth referencing element 132 is known, the location of indicating device 136 is also known. Likewise, the length of casing string 116 is known.

As further illustrated, casing string 124 is installed within casing string 116. Casing string 124 is run in the well on service string 128 until a indicating device 138 of casing string 124 engages with a depth referencing element 140 of casing string 116. Preferably, the engagement of indicating device 138 and depth referencing element 140 triggers a liner running weight response at the surface when interaction occurs. Thereafter, suspension tool 126 may be actuated to sealably and grippingly secure casing string 124 within casing string 116. The location of depth referencing element 140 is known and thus the location of indicating device 138 is known. Likewise, the length of casing string 124 is known. Depth referencing of any location within casing string 124 can thus be accomplished relative to the known and fixed position of the wellhead.

Even though FIG. 1 depicts a well having three casing strings for illustrative purposes, it should be understood by those skilled in the art that any number of casing strings may be deployed within a well without departing from the principles of the present invention. In addition, even though FIG. 1 depicts a land-based well environment, it should be understood by those skilled in the art that the apparatuses, systems and methods of the present invention are equally well suited for use in association with offshore well operations. Further, even though FIG. 1 depicts a vertical well, it should be understood by those skilled in the art that the apparatuses, systems and methods of the present invention are equally well suited for use in well having other directional configurations including horizontal wells, deviated wells, slanted wells, multilateral wells and the like. Accordingly, it should be understood by those skilled in the art that the use of directional terms such as above, below, upper, lower, upward, downward, left, right, uphole, downhole and the like are used in relation to the illustrative embodiments as they are depicted in the figures, the upward direction being toward the top of the corresponding figure and the downward direction being toward the bottom of the corresponding figure, the uphole direction being toward the surface of the well and the downhole direction being toward the toe of the well.

Figure 2:
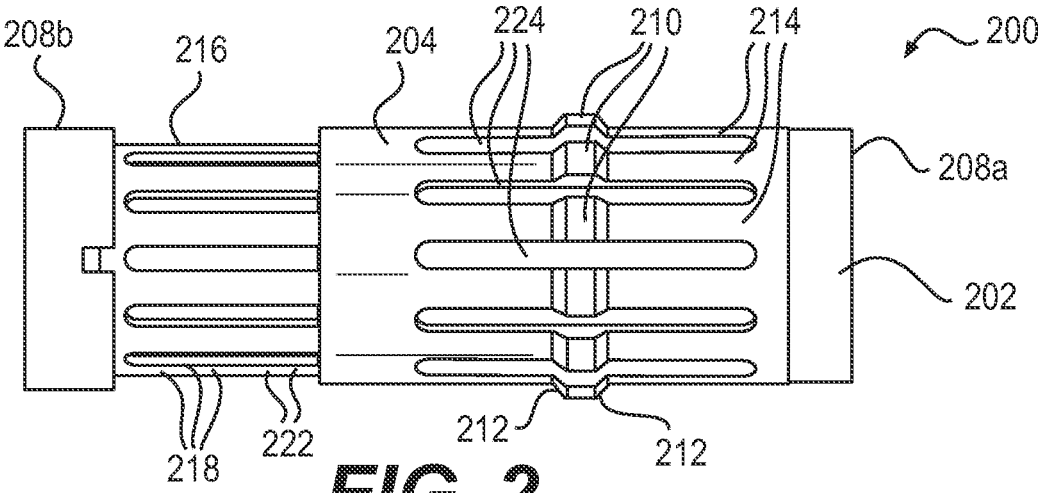
FIG. 2 illustrates a side view of a downhole indicating device with distinct snap-in and snap-out values, in accordance with one or more embodiments.
Figure 3:
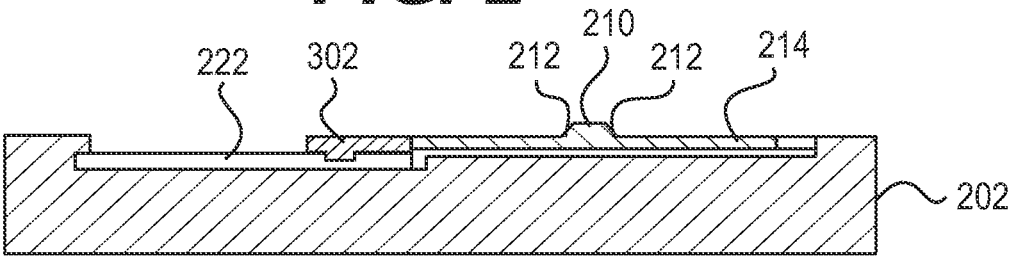
FIG. 3 illustrates a cross-sectional view of the indicating device of FIG. 2, in accordance with one or more embodiments.

FIG. 2. illustrates a side view of a downhole indicating device 200 with distinct snap-in and snap-out values, in accordance with one or more embodiments. FIG. 3 illustrates a cross-sectional view of the same. In an example application, the indicating device 200 may operate like the indicating device 138 of FIG. 1, in which the indicating device 200 is coupled to a casing string and lowered downhole and configured to engage with another downhole component or element, such as depth referencing element 140 to indicate a location of the downhole component. The downhole component may be similar to the depth referencing element 140 discussed in FIG. 1, or those having ordinary skill in the art will appreciate, may be any other component or element positionable downhole that may be able to engage with the indicating device.

The device 200 includes a collet body 202 and a slidable collet 204 located around the collet body 202. The slidable collet 204 is slidable along a length of the collet body 202 between one end (e.g., a low snap end 208*a*) and an opposite end (e.g., a high snap end 208*b*) from a low snap position to a high snap position. The slidable collet 204 includes a shoulder or one or more protrusions 210 located thereon and protruding outwardly from the collet body 202. The protrusions 210 may be formed integrally with the slidable collet 204. The protrusions 210 are also radially depressible towards the collet body 202. In the illustrated embodiment, the protrusions 210 have a trapezoidal shape with two oppositely angled oblique or tapered sides 212, as best seen in FIG. 3. However, the protrusion 210 could have a variety of other shapes. The protrusions 210 create an obstruction when the device 200 meets the downhole element and are momentarily depressed in a snapping motion in order to engage with the protrusions 210. In one or more embodiments, the protrusion 210 must also be depressed or snapped when disengaging from the protrusion 210.

The material, thickness, shape, and other characteristics of the slidable collet 204 can be selected to give the slidable collet 204 the desired amount of elasticity, stiffness, or general resistance to bending, such that the amount of force required to depress the protrusions 210 can be controlled. In one or more embodiments, the slidable collet 204 includes a plurality of axially extending collet ribs 214. For example, one or more elongated slots 224 may be formed within the slidable collet 204 to define the ribs 214 within the slidable collet 204. In such embodiments, one or more of the collet ribs 214 may include a protrusion 210. The width and number of collet ribs 214 are also design choices based on the desired elasticity, stiffness, or general resistance to bending of each collet rib 214 as well as the slidable collet 204 as a whole.

FIG. 2 illustrates a side view of the device 200 with the slidable collet 204 in the low snap position, in accordance with one or more embodiments. FIG. 3 illustrates a cross-sectional view of the same. In the low snap position, the one or more protrusions 210 are depressible towards the collet body 202 under a relatively low snap force applied on the protrusions 210, such as 5,000 lbs (22.2 kN). As shown in the cross-sectional view of FIG. 3, when the slidable collet 204 is in the low snap position, in one or more embodiments, there is a gap 214 in between the slidable collet 204 and the collet body 202. This gap 214 provides some room for the slidable collet 204 to flex when the protrusions 210 are depressed.

In one or more embodiments, in one or more embodiments, the device 200 further includes a support collet 216 surrounding a portion of the collet body 202 and located adjacent to the high snap end 208*b*. The protrusions 210 do not overlap the support collet 216 in the low snap position but do overlap the support collet 216 in the high snap position. The support collet 216 provides added stiffness to the slidable collet 204 when the slidable collet 204 is in the high snap position, thus requiring a higher snap force to in order to depress the protrusions 210. Accordingly, the low snap position may be referred to as an unsupported position for the slidable collet 204, as the support collet 216 is not substantially engaging and directly supporting the slidable collet 204, and the high snap position may be referred to as a supported position for the slidable collect 204, as the support collet 216 is substantially engaging and directly supporting the slidable collet 204.

In certain such embodiments, the support collet 216 comprises a plurality of collet ribs 218 that provide added stiffness and support to each of the plurality of collet ribs 214 of the slidable collet 204. For example, one or more elongated slots 222 may be formed within the support collet 216 to define the ribs 218 within the support collet 216. The support collet 216 may be fixed relative to the collet body 202 and rotationally fixed in relation to the slidable collet 204. In one or more embodiments, the slidable collet 204 includes a tab 302 inserted into one of the slots 222 of the support collet 216 so as to enable axial motion and prevent rotation motion between the slidable collet 204 and the support collet 216. Further, the support collet 216 and the slidable collet 204 may be rotationally align with each other such that the collet ribs 218 of the support collet 216 rotationally overlap with the collet ribs 214 of the slidable collet 204.

Figure 4A:
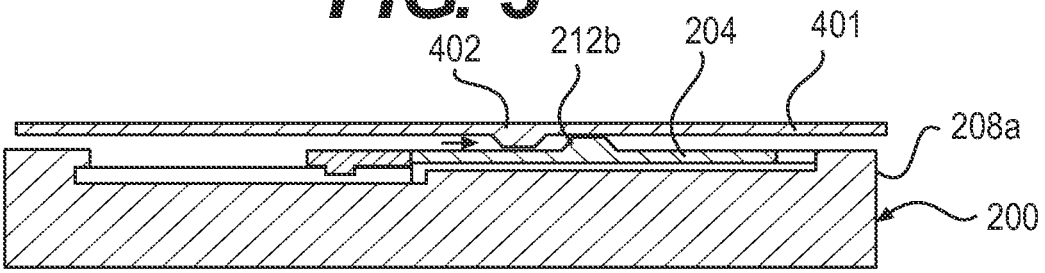
FIG. 4A illustrates the indicating device in a low snap position relative to another downhole component moving in a low snap direction, in accordance with one or more embodiments.
Figure 4B:
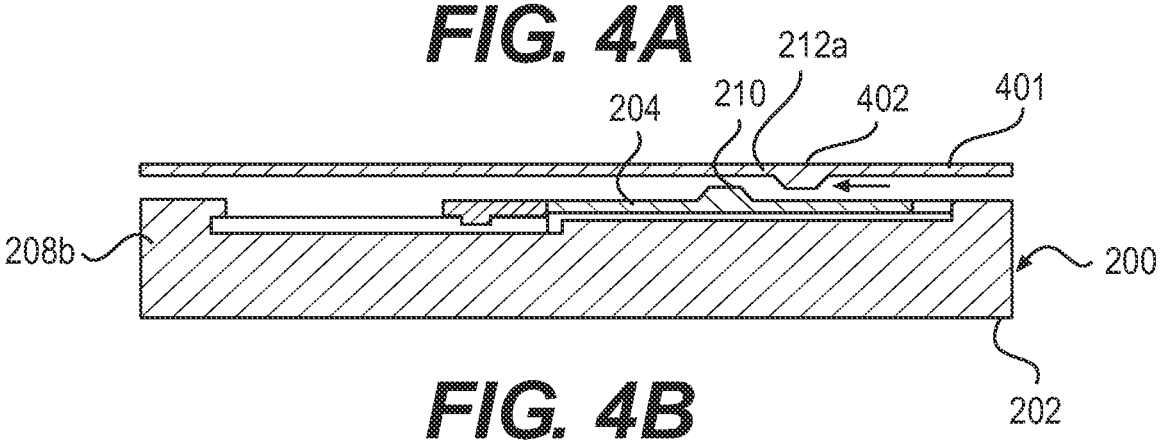
FIG. 4B illustrates the indicating device in a low snap position relative to another downhole component moving in a high snap direction, in accordance with one or more embodiments.

FIGS. 4A and 4B illustrate the device 200 in relation to a downhole component 401 to which the location of the device 200 is referenced. The downhole component 401 includes one or more protrusions or a shoulder 402. The protrusions 210 of the slidable collet 204 are typically depressed by a shoulder 402 moving relative to the slidable collet 204, such as when the device 200 is being lowered into hole or pulled out of hole and passes a certain position relative to another downhole component where the shoulder 402 is positioned. FIG. 4A illustrates the shoulder 402 moving towards the low snap end 208*a* of the collet body 202 when the slidable collet 204 is in the low snap position. A force applied onto a high snap side 212*b* of the protrusion 210 by the shoulder 402 may cause the protrusion 210 to depress. Specifically, the applied force comprises a radial component in the direction of the surface of the collet body 202, which causes the protrusions 210 to depress in said direction if the force is strong enough. In some embodiments, the oblique angle of the side 212*b* of the protrusions 210 translates a portion of an axial force applied by the shoulder onto the protrusions 210 into a radial component. As the protrusions 210 depress, the shoulder 402 is able to slide past the protrusions 210, indicating that the device 200 is at a certain location going a certain direction.

FIG. 4B illustrates the shoulder 402 moving towards the high snap end 208*b* of the collet body 202 when the slidable collet 204 is in the low snap position. As the shoulder 402 moves towards the high snap end 208*b*, the shoulder 402 applies a force onto the low snap side 212*a* of the protrusion 210. This force causes the slidable collet 204 to slide towards the high snap end 208*b* of the collet body 202 and into the high snap position shown in FIG. 5. Thus, the protrusion 210 only depresses in the low snap position when the shoulder 402 is pushing on the protrusion 210 towards the low snap end 212*a*. Otherwise, if the shoulder 402 pushes the protrusion 210 towards the high snap end 212*b*, the slidable collet 204 is moved out of the low snap position and into the high snap position.

Figure 5:
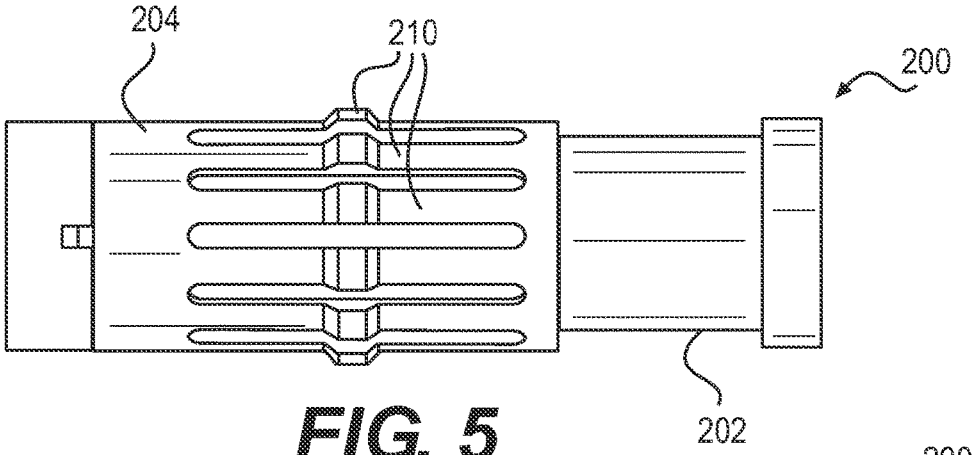
FIG. 5 illustrates the indicating device in a low snap relative to another downhole component moving in a low snap direction, in accordance with one or more embodiments.
Figure 6:
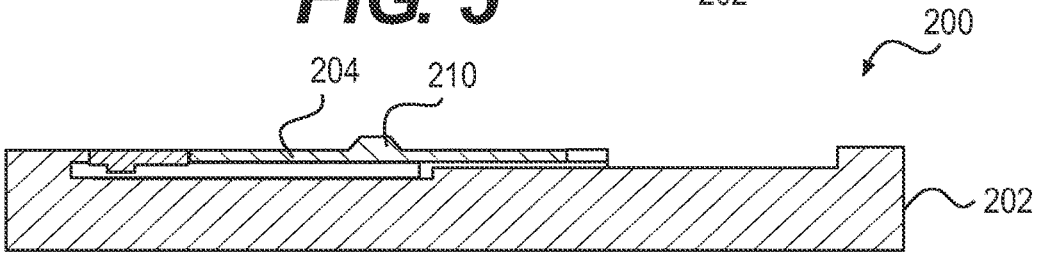
FIG. 6 illustrates a cross-sectional view of the indicating device of FIG. 5, in accordance with one or more embodiments.

FIG. 5 is a side view of the device 200 with the slidable collet 204 in the high snap position, in accordance with one or more embodiments. FIG. 6 is a cross-sectional view of the same. In the high snap position, the one or more protrusions 210 are depressible towards the collet body 202 under a relatively high snap force compared to the low snap force required in the low snap position. In one or more embodiments, the high snap force may be approximately 20,000 lbs (88.8 kN). In embodiments that include the support collet 216, which is hidden by the slidable collet 204 in FIG. 5 but visible in FIG. 6, the slidable collet 204 is located around the support collet 216 in the high snap position such that the support collet 216 is located between the collet body 202 and the slidable collet 204. As mentioned above, the support collet 216 adds to the stiffness of the slidable collet 204, requiring a higher snap force to depress the protrusions 210.

Figure 7A:
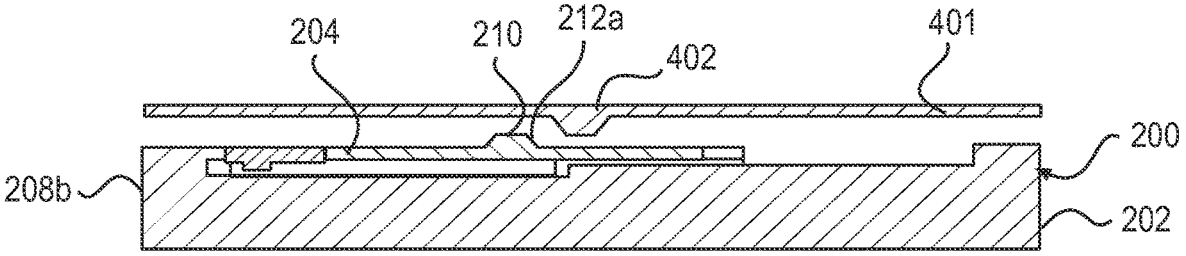
FIG. 7A illustrates the indicating device in a high snap position relative to another downhole component moving in a high snap direction, in accordance with one or more embodiments.
Figure 7B:
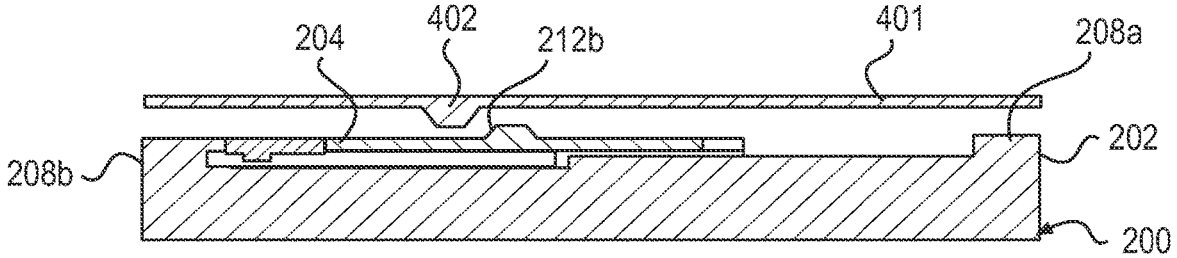
FIG. 7B illustrates the indicating device in a high snap position relative to another downhole component moving in a low snap direction, in accordance with one or more embodiments.

FIGS. 7A and 7B illustrate the device 200 in relation to the downhole component 401 to which the location of the device 200 is referenced. FIG. 7A illustrates the device 200 in which the shoulder 402 of the downhole component 401 is moving towards the high snap end 208*b* of the collet body 202 when the slidable collet 204 is in the high snap position. A force applied onto a low snap side 212*a* of the protrusions 210 by the shoulder 402 may cause the protrusions 210 to depress. Specifically, the force comprises a radial component in the direction of the collet body 202, which causes the protrusions 210 to depress in said direction if the force is strong enough. In some embodiments, the oblique angle of the low snap side 212*a* of the protrusions 210 translates a portion of the axial force applied by the shoulder 402 into a radial component. As the protrusions 210 depress, the shoulder 402 is able to slide past the protrusions 210 towards the high snap end 208*b*, indicating that the device 200 is at a certain location.

FIG. 7B illustrates the device 200 in which the shoulder 402 is moving towards the low snap end 208*a* of the collet body 202 when the slidable collet 204 is in the high snap position. As the shoulder 402 moves towards the low snap end 208*a*, the shoulder 402 applies a force onto the high snap side 212*b* of the protrusion 210. This force pushes the slidable collet 204 towards the low snap end 208*a* of the collet body 202 and into the low snap position shown in FIG. 3. Thus, the protrusion 210 only depresses in the high snap position when the shoulder 402 is pushing on the protrusion 210 towards the high snap end 208*a*. Otherwise, if the shoulder 402 pushes the protrusion 210 towards the low snap end 208*a*, the slidable collet 204 is moved out of the high snap position and into the low snap position.

Figure 8A:
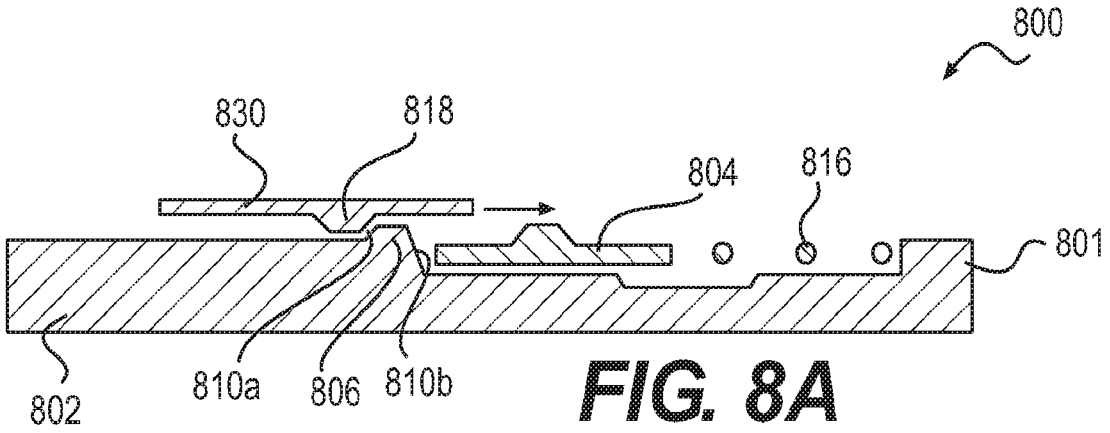
FIG. 8A illustrates another embodiment of a downhole indicating device in a low snap position, in accordance with one or more embodiments.
Figure 8B:
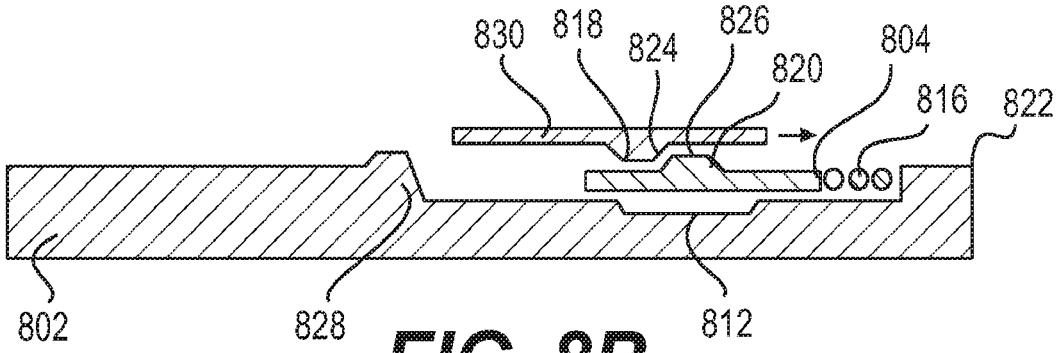
FIG. 8B illustrates the indicating device of FIG. 8A in a low snap position, in accordance with one or more embodiments.
Figure 8C:
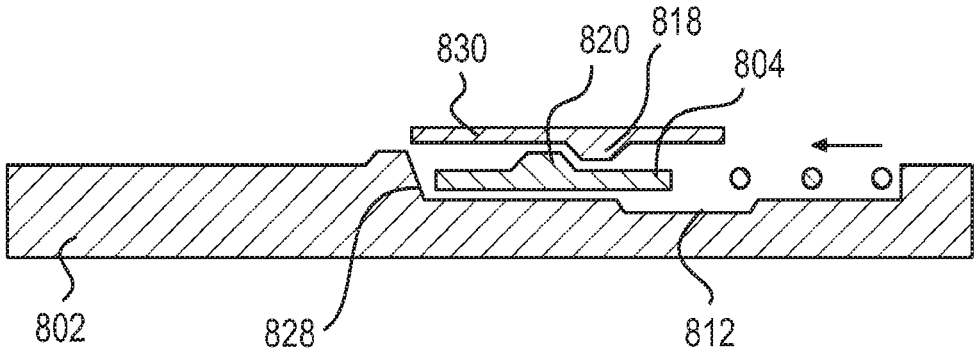
FIG. 8C illustrates the indicating device of FIG. 8B in a high snap position, in accordance with one or more embodiments.

FIGS. 8A-8C illustrate cross-sectional views of another embodiment of a downhole indicating system 800 in various positions. The system 800 includes a indicating device 801 movable relative to another downhole component 830. For example, the component 830 may be of another tool or device separate from the indicating device 801, or the component 830 may be a collet or sleeve positioned about and carried by the indicating device 801. The device 801 includes a collet body 802 and a slidable collet 804 movable between a low snap position and a high snap position relative to the collet body 802. In one or more embodiments, the device 801 also includes a spring 816 which biases the slidable collet 804 into the high snap position, as shown in FIG. 8A. The downhole component 830 includes one or more protrusions or a shoulder 818 to interact with the device 801, in which the indicating device is used to indicate a location relative to said downhole component 830.

In one or more embodiments, the collet body 802 includes a shoulder or one or more protrusions 806 located on the collet body 801. FIG. 8A illustrates the shoulder 818 of the downhole component 830 pushing on a first side 810*a* of the protrusion 806. This protrusion 806 is radially depressible by the shoulder 818 given a high enough force applied to the protrusion. In one or more embodiments, the first side 810*a* of the protrusion 806 is at an oblique angle that translates an axial force applied by the shoulder 818 into a radial component. If the force is strong enough, the protrusion 806 will depress and allow the shoulder 818 to snap past. The shoulder 818 may also snap past the protrusion 806 going in the opposite direction and applying a force on the second side 810*b* of the protrusion 806. The snap force required can be set by designing the protrusion to have a certain amount of resistance, which may be determined by parameters such as thickness and material of the protrusion 806 and/or collet body 801, the angles of the sides 810, among others. In one or more embodiments, the snap force required for the shoulder 818 to depress the protrusion 806 moving in one direction can be different than the snap force required for the shoulder 818 to depress the protrusion 806 moving in the opposite direction. For example, the angles of the two oblique sides 810 may be different, which differentiates the amount of axial force required to be applied by the shoulder 818 to garner enough radial force to depress the protrusion 806.

FIG. 8B illustrates the shoulder 818 moving the slidable collet 804 from the high snap position to the low snap position. In the low snap position, a protrusion 820 of the slidable collet 804 is positioned over a recess 812 of the collet body. The recess 812 provides the slidable collet 804 with room to flex when the protrusion 820 is depressed. Thus, a relatively low snap force is required to depress the protrusion 820. In one or more embodiments, a spring 816 or other biasing device is located between the slidable collet 804 and a low snap end 822 of the collet body 802. A the shoulder 818 pushes the slidable collet 804 towards to low snap end 822 and into the low snap position, the spring 816 is compressed. The spring is 816 fully compressed when the slidable collet 804 is in the low snap position. Thus, continued pushing of the shoulder 818 causes the protrusion 820 to depress towards the recess 812 until the shoulder 818 snaps past the protrusion 820 towards the low snap end 822. In one or more embodiments, at least one of the shoulder 818 and the protrusion 820 includes an oblique side 824, 826 with which the other interfaces. Thus, an axial force applied by the shoulder 818 is translated into a radial force component that causes the protrusion 820 to depress. After the shoulder 818 snaps past the protrusion 820 towards the low snap end 822, the spring 816 pushes the slidable collet 804 towards a high snap end 828 and into the high snap position.

FIG. 8C illustrates the slidable collet 804 in the high snap position, in which the protrusion 820 is located over a nonrecessed portion of the collet body 802. The collet body 802 provides extra support and resistance to the protrusion 820. Thus, a higher snap force is required to depress the protrusion 820 compared to when the slidable collet 804 is in the low snap position and over the recess 812. When in the high snap position, the protrusion 820 is depressible by the shoulder 818 pushing on the protrusion 820 in the direction of the high snap end 828. When a high enough radial force is applied to the protrusion 820, the protrusion 820 depresses and the shoulder 818 snaps past the protrusion 820 towards the high snap end 828.

Accordingly, the low snap position may be referred to as an unsupported position for the slidable collet 804, as the slidable collet 804 is not substantially engaged or supported by the collet body 802 due to the presence of the recess 812, and the high snap position may be referred to as a supported position for the slidable collect 804, as the slidable collet 804 is substantially engaged or supported by the collet body 802 due to the absence of the recess 812. Further, the indicating device 800 provides three snap positions which may have three distinct snap values. Other embodiments may provide additional snap positions and snap values by incorporating additional protrusions designed to require different snap forces to be depressed.

In addition to the embodiments described above, many examples of specific combinations are within the scope of the disclosure, some of which are detailed below:

Example 1. A downhole indicating device, comprising:
- a collet body; and
- a slidable collet comprising a protrusion and surrounding and slidable along a length of the collet body between a low snap position and a high snap position;
- wherein in the low snap position, the protrusion is depressible under a low snap force, and in the high snap position, the protrusion is depressible under a high snap force, the low snap force being less than the high snap force.

Example 2. The device of Example 1, further comprising a downhole component comprising a shoulder to engage and depress the protrusion of the slidable collet with a low snap force or a high snap force.

Example 3. The device of Example 1 or 2, wherein the protrusion comprises an oblique surface such that the shoulder of the downhole component engages the oblique surface to depress the protrusion radially towards the collet body.

Example 4. The device of Example 1 to 3, wherein the slidable collet comprises a plurality of collet ribs, each collet rib comprising one of a plurality of protrusions.

Example 5. The device of Example 1 to 4, further comprising a support collet surrounding the collet body, wherein the slidable collet is movable with respect to and slidable over the support collet, and wherein the protrusion of the slidable collet overlaps the support collet in the high snap position and does not overlap in the low snap position.

Example 6. The device of Example 1 to 5, wherein the support collet is fixed with respect to the collet body.

Example 7. The device of Example 1 to 6, wherein the support collet comprises a plurality of ribs and the slidable collet comprises a plurality of ribs, each of the plurality of ribs of the slidable collet comprising one of a plurality of protrusions.

Example 8. The device of Example 1 to 7, wherein the support collet and the slidable collet are rotationally fixed with respect to each other and the ribs of the support collet and the ribs of the slidable collet rotationally overlap with respect to each other.

Example 9. A downhole indicating system, comprising:
- a downhole component comprising a shoulder; and
- a downhole indicating device movable with respect to the shoulder, the indicating device comprising:
- a collet body; and
- a slidable collet comprising a protrusion and coupled to and slidable along the collet body between a low snap position and a high snap position;
- wherein in the low snap position, the protrusion is depressible under a low snap force applied by the shoulder; and
- wherein in the high snap position, the protrusion is depressible under a high snap force applied by the shoulder, the low snap force being less than the high snap force.

Example 10. The system of Example 9, wherein the slidable collet is movable between the low snap position and the high snap position via a force applied by the shoulder to the protrusion.

Example 11. The system of Example 9 or 10, wherein the slidable collet comprises a plurality of collet ribs, each collet rib comprising one of a plurality of protrusions.

Example 12. The system of Example 9 to 11, further comprising a support collet surrounding a portion of the collet body, wherein the slidable collet is movable with respect to the support collet, and wherein the protrusion of the slidable collet overlaps the support collet in the high snap position and does not overlap in the low snap position.

Example 13. The system of Example 9 to 12, wherein the support collet comprises a plurality of ribs and the slidable collet comprises a plurality of ribs, each of the plurality of ribs of the slidable collet comprising one of a plurality of protrusions.

Example 14. The system of Example 9 to 13, wherein the support collet and the slidable collet are rotationally fixed with respect to each other and the ribs of the support collet and the ribs of the slidable collet rotationally overlap with respect to each other.

Example 15. The system of Example 9 to 14, wherein the protrusion comprises an oblique surface such that the shoulder of the downhole component engages the oblique surface to depress the protrusion radially towards the collet body.

Example 16. A method of indicating a downhole position of a shoulder of a downhole component, comprising:
- positioning an indicating device adjacent the downhole component;
- moving a protrusion along a collet body of the indicating device between a supported position and an unsupported position;

depressing the protrusion of the indicating device towards the collet body with the shoulder of the downhole component; and moving the shoulder of the downhole component across the protrusion of the indicating device.

Example 17. The method of Example 16, wherein:

a slidable collet comprises the protrusion;

the moving the protrusion comprises moving the slidable collet along the collet body of the indicating device between a low snap position and a high snap position;

in the low snap position, the protrusion is depressible under a low snap force; and in the high snap position, the protrusion is depressible under a high snap force, the low snap force being less than the high snap force.

Example 18. The method of Example 16 or 17, wherein the moving the slidable collet comprises applying an axial force to the slidable collet with the shoulder of the downhole component to move the slidable collet between the low snap position and the high snap position.

Example 19. The method of Example 16 to 18, wherein, in the high snap position, a support collet is positioned between the collet body and the protrusion.

Example 20. The method of Example 16 to 19, further comprising indicating a location of the indicating device or the downhole component downhole within a borehole after the moving the shoulder of the downhole component across the protrusion of the indicating device.

This discussion is directed to various embodiments of the invention. The drawing figures are not necessarily to scale. Certain features of the embodiments may be shown exaggerated in scale or in somewhat schematic form and some details of conventional elements may not be shown in the interest of clarity and conciseness. Although one or more of these embodiments may be preferred, the embodiments disclosed should not be interpreted, or otherwise used, as limiting the scope of the disclosure, including the claims. It is to be fully recognized that the different teachings of the embodiments discussed may be employed separately or in any suitable combination to produce desired results. In addition, one skilled in the art will understand that the description has broad application, and the discussion of any embodiment is meant only to be exemplary of that embodiment, and not intended to intimate that the scope of the disclosure, including the claims, is limited to that embodiment.

Certain terms are used throughout the description and claims to refer to particular features or components. As one skilled in the art will appreciate, different persons may refer to the same feature or component by different names. This document does not intend to distinguish between components or features that differ in name but not function, unless specifically stated. In the discussion and in the claims, the terms "including" and "comprising" are used in an open-ended fashion, and thus should be interpreted to mean "including, but not limited to . . . ." Also, the term "couple" or "couples" is intended to mean either an indirect or direct connection. In addition, the terms "axial" and "axially" generally mean along or parallel to a central axis (e.g., central axis of a body or a port), while the terms "radial" and "radially" generally mean perpendicular to the central axis. The use of "top," "bottom," "above," "below," and variations of these terms is made for convenience, but does not require any particular orientation of the components.

Reference throughout this specification to "one embodiment," "an embodiment," or similar language means that a particular feature, structure, or characteristic described in connection with the embodiment may be included in at least one embodiment of the present disclosure. Thus, appearances of the phrases "in one embodiment," "in an embodiment," and similar language throughout this specification may, but do not necessarily, all refer to the same embodiment.

Although the present invention has been described with respect to specific details, it is not intended that such details should be regarded as limitations on the scope of the invention, except to the extent that they are included in the accompanying claims.

What is claimed is:

1. A downhole indicating device, comprising:

a collet body; and a slidable collet surrounding a portion of the collet body, the slidable collet comprising a protrusion and surrounding and slidable along a length of the collet body between a low snap position and a high snap position;

wherein in the low snap position, the protrusion is depressible under a first snap force, and in the high snap position, the protrusion is depressible under a second snap force, the first snap force being less than the second snap force.

2. The device of claim 1, further comprising a downhole component comprising a shoulder to engage and depress the protrusion of the slidable collet with the first snap force or the second snap force.

3. The device of claim 2, wherein the protrusion comprises an oblique surface such that the shoulder of the downhole component engages the oblique surface to depress the protrusion radially towards the collet body.

4. The device of claim 1, wherein the slidable collet comprises a plurality of collet ribs, each collet rib comprising one of a plurality of protrusions.

5. The device of claim 1, further comprising a support collet surrounding the collet body, wherein the slidable collet is movable with respect to and slidable over the support collet, and wherein the protrusion of the slidable collet overlaps the support collet in the high snap position to increase the force required to depress the protrusion from the first snap force to the second snap force and does not overlap in the low snap position.

6. The device of claim 5, wherein the support collet is fixed with respect to the collet body.

7. The device of claim 5, wherein the support collet comprises a plurality of ribs and the slidable collet comprises a plurality of ribs, each of the plurality of ribs of the slidable collet comprising one of a plurality of protrusions.

8. The device of claim 7, wherein the support collet and the slidable collet are rotationally fixed with respect to each other and the ribs of the support collet and the ribs of the slidable collet rotationally overlap with respect to each other.

9. A downhole indicating system, comprising:

a downhole component comprising a shoulder; and a downhole indicating device movable with respect to the shoulder, the indicating device comprising:

a collet body; and a slidable collet surrounding a portion of the collet body, the slidable collet comprising a protrusion and coupled to and slidable along the collet body between a low snap position and a high snap position;

wherein in the low snap position, the protrusion is depressible under a first snap force applied by the shoulder; and wherein in the high snap position, the protrusion is depressible under a second snap force applied by the shoulder, the first snap force being less than the second snap force.

10. The system of claim 9, wherein the slidable collet is movable between the low snap position and the high snap position via a force applied by the shoulder to the protrusion.

11. The system of claim 9, wherein the slidable collet comprises a plurality of collet ribs, each collet rib comprising one of a plurality of protrusions.

12. The system of claim 9, further comprising a support collet surrounding a portion of the collet body, wherein the slidable collet is movable with respect to the support collet, and wherein the protrusion of the slidable collet overlaps the support collet in the high snap position to increase the force required to depress the protrusion from the first snap force to the second snap force and does not overlap in the low snap position.

13. The system of claim 12, wherein the support collet comprises a plurality of ribs and the slidable collet comprises a plurality of ribs, each of the plurality of ribs of the slidable collet comprising one of a plurality of protrusions.

14. The system of claim 13, wherein the support collet and the slidable collet are rotationally fixed with respect to each other and the ribs of the support collet and the ribs of the slidable collet rotationally overlap with respect to each other.

15. The system of claim 9, wherein the protrusion comprises an oblique surface such that the shoulder of the downhole component engages the oblique surface to depress the protrusion radially towards the collet body.

16. A method of indicating a downhole position of a shoulder of a downhole component, comprising:

positioning an indicating device adjacent the downhole component;

moving a slidable collet comprising a protrusion along the collet body of the indicating device between a low snap position and a high snap position, wherein in the low snap position, the protrusion is depressible under a first snap force and in the high snap position, the protrusion is depressible under a second snap force, the first snap force being less than the second snap force;

depressing the protrusion of the indicating device towards the collet body with the shoulder of the downhole component; and moving the shoulder of the downhole component across the protrusion of the indicating device.

17. The method of claim 16, wherein the moving the slidable collet comprises applying an axial force to the slidable collet with the shoulder of the downhole component to move the slidable collet between the low snap position and the high snap position.

18. The method of claim 16, wherein, in the high snap position, a support collet is positioned between the collet body and the protrusion to increase the force required to depress the protrusion from the first snap force to the second snap force.

19. The method of claim 16, further comprising indicating a location of the indicating device or the downhole component downhole within a borehole after the moving the shoulder of the downhole component across the protrusion of the indicating device.

* * * * *